United States Patent [19]

Carter

[11] Patent Number: 4,615,255

[45] Date of Patent: Oct. 7, 1986

[54] SHOTGUN SHELL RELOADER APPARATUS

[75] Inventor: Jack O. Carter, Des Moines, Iowa

[73] Assignees: J. L. Rice; H. D. Warner, both of Litchfield Park, Ariz. ; a part interest to each

[21] Appl. No.: 822,202

[22] Filed: Jan. 24, 1986

[51] Int. Cl.[4] ..... F42B 33/02; F42B 33/10

[52] U.S. Cl. ..... 86/27; 86/23; 86/25; 86/28; 86/29; 86/30; 86/31; 86/36; 86/37; 86/38

[58] Field of Search ..... 86/23, 24, 25, 27, 28, 86/29, 30, 31, 32, 33, 36, 37, 38, 39, 40, 41, 44, 46

[56] References Cited

U.S. PATENT DOCUMENTS

| | | | |
|---|---|---|---|
| 3,060,788 | 10/1962 | Blesi et al. . | |
| 3,097,560 | 7/1963 | Ponsness et al. | 86/27 |
| 3,483,792 | 12/1969 | Williams | 86/27 |
| 3,973,465 | 8/1976 | Bachhuber et al. | 86/36 |
| 4,031,804 | 6/1977 | Boschi | 86/27 |
| 4,343,222 | 8/1982 | Dillon | 86/27 |
| 4,522,102 | 6/1985 | Pickens | 86/24 |
| 4,526,084 | 7/1985 | David et al. | 86/27 |

*Primary Examiner*—Stephen J. Lechert, Jr.
*Assistant Examiner*—Howard J. Locker
*Attorney, Agent, or Firm*—James H. Phillips; Charles E. Cates

[57] ABSTRACT

In order to increase the efficiency and reliablility of shotgun shell reloader apparatus of the type in which an empty shell is entered and removed at a single entrance/exit station and the shell is transferred in a circular path from station to station at which the several reloading operations are performed sequentially, an accessory ejection spring is employed to automatically eject a completed shell as it enters the entrance/exit station (thus eliminating the necessity for manually handling a completed shell at the entrance/exit station) and a spring pad including a magnetic member is employed at the priming station to positively receive and emplace a new primer just prior to the repriming operation (thus eliminating instances of incorrect orientation of the new primer with respect to the deprimed shell into which it is to be seated during the priming operation).

4 Claims, 13 Drawing Figures

SHOTGUN SHELL RELOADER APPARATUS

FIELD OF THE INVENTION

This invention relates to the firearm ammunition arts and, more particularly, to the art of shotgun shell hand reloading and improvements to existing reloader apparatus widely used for facilitating such hand reloading.

BACKGROUND OF THE INVENTION

Many sportsmen who participate in hunting and/or target shooting using a shotgun undertake to reload fired shotgun shells on a routine basis. A principal reason for this activity is that hand reloaded shells are much less expensive than new shells. In addition, in some instances, it is believed that a more precise and individually adjusted load may be obtained to especially suit a given user. Still further, there is a feeling among some sportsmen that the craftsman-like reloading of used shotgun shells is an accomplishment in itself.

In order to facilitate shotgun shell hand reloading, a number of reloaders for semi-automating the process are commercially available. Typically, these reloaders have a rotatable turntable structure which permits indexing of shotgun shells from station-to-station with a separate reloading operation being performed at each station. These operations include depriming, repriming, powder charging, wad column charging, shot charging and crimping. In many of the commercially available units, these operations are performed by actuating a lever to simultaneously perform reloading operations on an array of shells at different stations and at different stages of reloading.

While the best of the commercially available shotgun shell reloaders are convenient and reliable, there are two problems associated with their use which persist. A single station is employed, in many examples of the available reloaders, for both introducing spent shells (vertically upstanding, primer end down) and removing completed shells. (The shells are constrained against removal at all other stations in order that the shell position at each station is accurately defined to permit carrying out the several reloading steps.) The disadvantage of this arrangement is that a completed shell must be manually removed at the entrance/exit station before a spent shell is manually inserted at the same station. This necessity to manually handle the completed shells individually, as well known to those skilled in the art, is a distinct deterrent to the efficiency with which the reloading process is carried out.

Second, it is necessary to emplace a new primer, either from a dispenser or manually, in a receptacle intermediate the entrance/exit station and a second station at which the repriming operation is performed. As the shell carrier is indexed, the new primer is carried to the first station ahead of the shell, and the primer is supposed to then fall, under the influence of gravity, into an axial aperture in a spring pad to await the repriming operation. Again, as those skilled in the art will appreciate, the new primers do not always drop into the spring pad aperture in the correct position for the subsequent repriming operation, the force of gravity being insufficient to secure infallible operation of this intermediate step.

The present invention is directed to definitively solving both these problems.

OBJECTS OF THE INVENTION

It is therefore a broad object of my invention to provide improved shotgun shell reloading apparatus.

It is a more specific object of my invention to provide an attachment to shotgun shell reloading apparatus of the multiple station, turret type which serves to automatically eject a completed shell from the entrance/exit station as a completed shell reaches that station.

In another aspect, it is a more specific object of my invention to provide means for insuring the correct emplacement of a new primer at the priming station of a shotgun shell reloader as the turret is indexed to subsequently position a shell at the repriming station.

SUMMARY OF THE INVENTION

Briefly, these and other objects of my invention are achieved by first providing a spring attachment which progressively engages a completed shell beginning intermediate the station at which a final reloading operation has been performed and the entrance/exit station such that, when the completed shell reaches the entrance/exit station (at which it is no longer constrained on the turret), the spring ejects the shell radially outwardly and returns to its unflexed state. Optionally, a funnel may be situated below the entrance/exit station to catch an ejected shell and orient it to a uniform angle and position as it passes through and issues from the small end of the funnel.

In order to insure that a new primer is correctly positioned in the axial aperture of the spring pad at the repriming station, the post supporting the spring pad from beneath the worktable assembly terminates, at its upper end, in a cylindrical magnet which extends into the axial aperture from beneath to magnetically positively pull the primer from its receptacle onto the top of the magnet in anticipation of the repriming operation.

BRIEF DESCRIPTION OF THE DRAWING

The subject matter of the invention is particularly pointed out and distinctly claimed in the concluding portion of the specification. The invention, however, both as to organization and method of operation, may best be understood by reference to the following description taken in conjunction with the subjoined claims and the accompanying drawing of which:

DETAILED DESCRIPTION OF THE INVENTION

Figure 1:
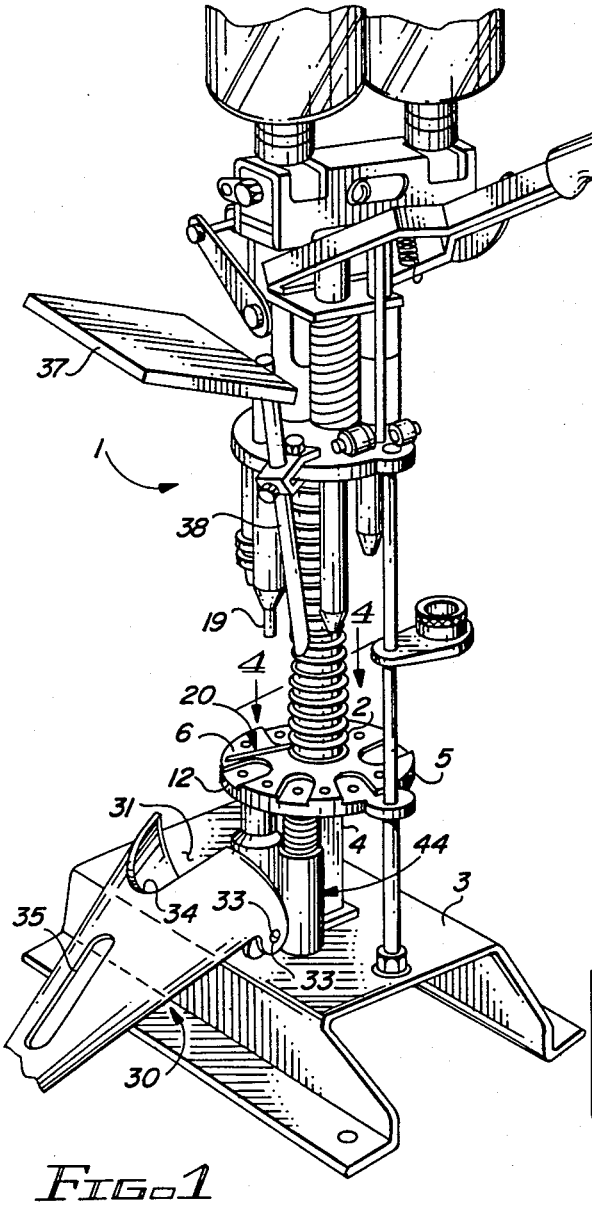
FIG. 1 is a perspective view of a generalized shotgun shell reloader which incorporates my improvements.

Referring now to FIG. 1, a typical commercially available shotgun shell reloader 1 is shown with my improvements incorporated. A column 2 is vertically supported by a base assembly 3 which is adapted for stably supporting the entire mechanism on a table, stand or the like (not shown). As best seen by brief reference to FIG. 2, the vertical column 2 is square in cross section and, as shown in FIG. 1, is telescoped for orientation and support into a correspondingly larger dimension square sleeve 4 which depends upwardly from the base assembly 3. A generally circular work table 5 welded to the top of the sleeve 4 supports a shell carrier 6 which is rotatable about the column 2. Shell carrier 6 is fabricated of a non-magnetic material in accordance with a feature of the invention. A column compression spring 7 extends between a position slightly above the shell carrier 6 to the undersurface of a turret assembly 8 which supports much of the mechanism for effecting various reloading operations at a series of circumferentially distributed stations as will be described more fully below. As those skilled in the art will readily understand, the column spring 7 urges the turret assembly 8 upwardly to a normal inoperative position. When a downward force is applied at a handle 9, the turret assembly 8 and the mechanisms carried by it move downwardly against the column spring 7, and various reloading operations are actuated.

Figure 2:
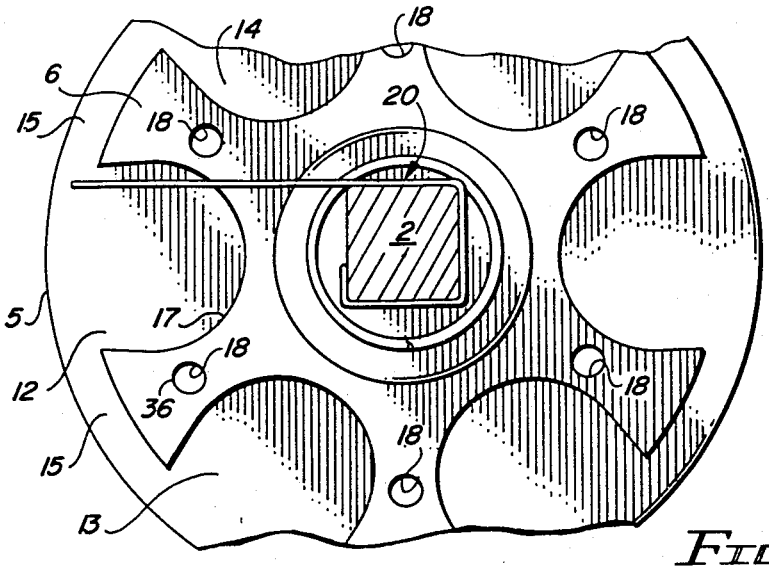
FIG. 2 is a partially cut-away cross section taken along the lines 2—2 of FIG. 1 and illustrates the manner in which an accessory ejection spring according to my invention is incorporated into the reloader illustrated in FIG. 1.

Referring to both FIGS. 1 and 2, a plurality of stations (six in the example) are equally angularly circumferentially distributed about the worktable 5 such that upright shells, base end down, may be introduced to the worktable at a first entrance/exit station 12 and indexed to a second work station 13 and through successive work stations to a final work station 14 by rotation of a shell carrier 6. The work table 5 has a circumferential lip 15 that is relieved only in the area 16 at the entrance/exit work station 12 to permit inserting and removing shells. Each shell receiving position of the shell carrier 6 is defined by a radially directed recess, and the recesses in the shell carrier 6 for receiving the shells have semi-circular portions, such as at 17, of a radius just sufficient to capture the outer rim of the shell base to securely support the shells as they are moved from station to station by rotation of the shell carrier 6. The lip 15 serves to confine the shells against removal at all positions except at the entrance/exit work station 12.

In accordance with normal practice in operating shotgun shell reloaders of the general type just described, a spent empty shotgun shell is manually introduced into engagement with the shell carrier 6 at the entrance/exit station 12, and a depriming operation is then performed by actuating the handle 9 downwardly to push the expended primer out the bottom of the shell base by the action of a deprime punch 20. The shell carrier 6 is then incrementally rotated counterclockwise to advance a shell to successive stations at which repriming (as will be discussed more fully below), powder charging, wad column charging, shot charging and crimping operations are performed to obtain a completed shell after the final operation performed at the final station 14. Those skilled in the art will understand that it is normal practice to introduce another empty shell at the entrance/exit station 12 each time the shell carrier 6 is indexed a distance of one station such that, except for the beginning and end of a reloading session, shells at various stages of completion will be situated at each of the several work stations.

According to the customary operation of shotgun shell reloaders of the class described, two separate manual operations must be performed to handle the shotgun shells at the entrance/exit station 12. When a shell has been completed at the final station 14, the shell carrier 6 is rotated to bring this just-completed shell to the entrance/exit station 12. It is then manually removed by hand and set aside as may be appropriate. Then the operator selects an empty shell from a supply of empty shells and inserts it at the entrance/exit station 12 after which the handle 9 can be actuated to perform the several reloading steps at the correspondingly several stations.

Figure 3:
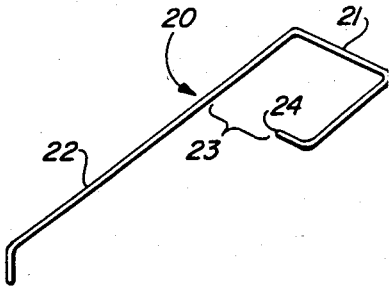
FIG. 3 is a single element pictorial illustrating an exemplary configuration for the shell ejection spring.
Figure 4:
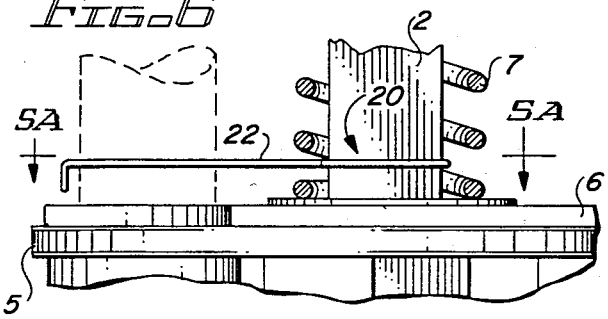
FIG. 4 illustrates the installed vertical orientation of the ejection spring illustrated in FIGS. 1, 2 and 3.

In order to increase the efficiency of the reloading operation, the manual removal of completed shotgun shells is eliminated according to the present invention. This is achieved by the incorporation into the mechanism of an accessory ejection spring. As best shown in FIG. 3, the spring includes a tail end 21 formed to encompass most of the circumference of the column 2 to which it may be operatively attached by snapping into place as facilitated by the provision of the space 23 between a straight free end portion 22 of the spring and the termination 24 of the tail end 21. The free end of the spring 20, as best shown in FIG. 2, extends generally tangentially from one side of the column 2 and terminates proximate the outer edge of the shell carrier 6 and proximate the edge of the entrance/exit station 12 closest to the final station 14. Thus, the free end portion 22 of the spring 20 is disposed generally parallel to a radius extending from the column 2 through the center of the entrance/exit station 12. As shown in FIG. 4, the spring is generally horizontally disposed at a position just above the shell carrier 6 to insure that it will bear against the base of a shell rather than against the paper or plastic shell casing.

Figure 6:
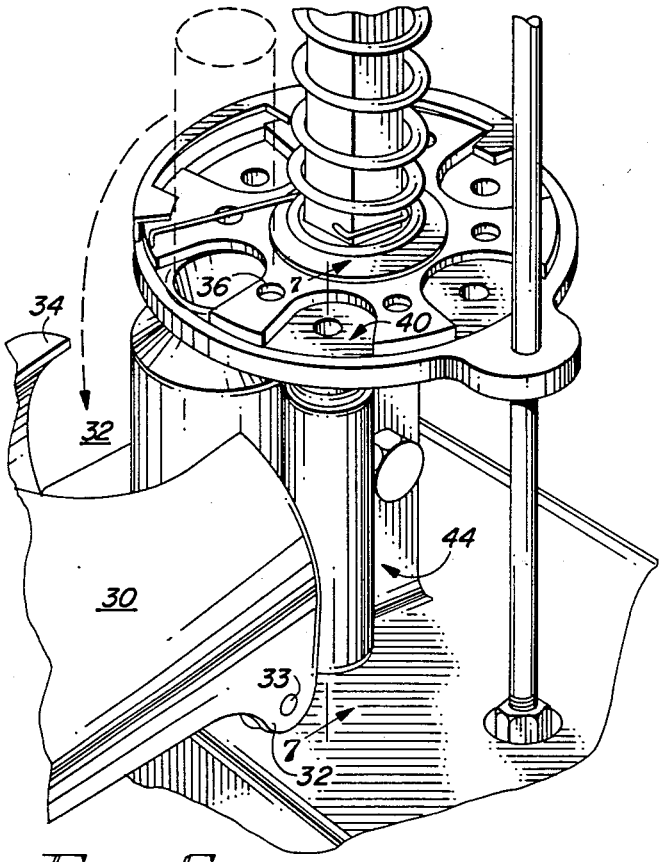
FIG. 6 is an enlarged fragmentary view of the work table area of the reloader shown in FIG. 1 and particularly illustrates the use of a specially configured funnel for catching and orienting completed shells ejected by the spring.
Figure 5A:
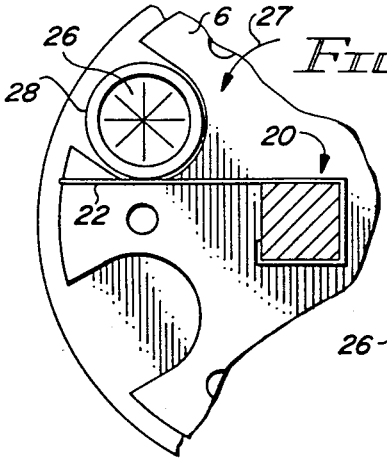
FIGS. 5*a*, 5*b* and 5*c* illustrate the sequential engagement by the spring of a completed shell in transit from a final station until it is ejected by the spring from the entrance/exit station of the reloader.
Figure 5B:
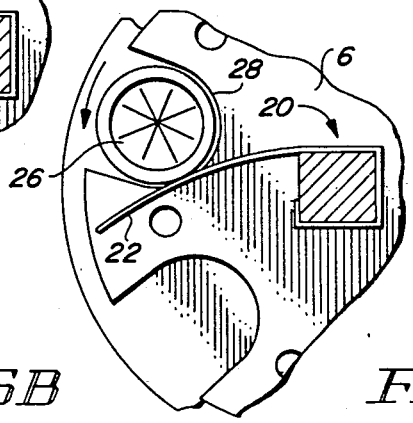
Figure 5C:
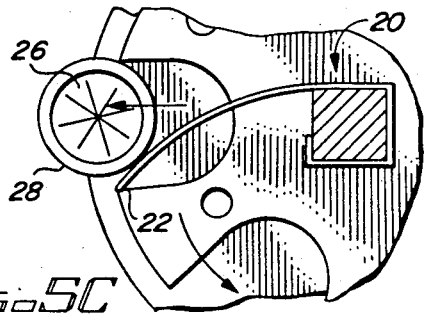

The function of the spring 20 may best be appreciated by reference to the sequential views illustrated in FIGS. 5*a*, 5*b*, and 5*c* and to FIG. 6. In FIG. 5*a*, a completed shell 26 has been carried by the shell carrier 6 from the final station toward the entrance/exit station as indicated by the arrow 27. At this intermediate position, the free end 22 of the spring 20 has just been engaged by the metal base 28 of the shell 26. In FIG. 5*b*, the pressure of the shell 28 has begun to deflect the free end 22 of the spring 20 in the direction shown. In FIG. 5*c*, the shell 26 has just completely entered the entrance/exit port 12 (FIG. 2) at which the lip 15 of the work table 5 is relieved and is therefore urged radially outwardly by the tension stored in the deflected spring. Immediately after the completed shell 26 is ejected, the spring 20 resumes its unflexed state.

As another feature of the ejection system, the ejected shell is caught in the large entrance end 31 of a funnel 30 as shown in FIG. 1 and, particularly, in FIG. 6. The funnel 30 is positioned generally below the entrance/exit station 12 of the shell carrier 6 and may be attached to the base assembly 3 by tabs 32 which fit over pins 33 which are existing components of certain commercially available reloaders or by any other convenient means. A U-shaped notch 34 may be provided in the top of the large end of the funnel to facilitate disposing the funnel at an angle between the horizontal and the vertical. Orienting the funnel in that manner serves to slow the passage of the completed shells through the funnel such that they are gently deposited from the funnel small end for subsequent handling. Experience has shown that ejected shells will occasionally enter the funnel large end and "jam". An longitudinal slot 35 (FIG. 1) permits any such occasional jam to be cleared by the insertion of the operator's finger to appropriately reorient the jammed shell. Another longitudinal notch (not shown) may be provided in the funnel small end at the bottom to promote the upright deposit of completed shells.

Those skilled in the shotgun shell hand reloading art will understand that the first operation typically performed on a shell being processed (after a preliminary depriming operation which, in the exemplary reloader disclosed herein, is performed at the entrance/exit station) is repriming which is performed at a second station positioned adjacent the first (entrance/exit) station. In the class of reloader to which this invention pertains, a new primer is deposited into the single receptacle 36 (of several like receptacles 18) situated between the entrance/exit station 12 and the second station 13 as best shown in FIGS. 2 and 6. This operation may be performed manually or automatically if the reloader is provided with an automatic primer feed such as that represented by the primer tray 37 (FIG. 1) and primer feed tube 38. (Reference may be taken to U.S. Pat. No. 3,973,465 entitled "Automatic Primer Feed for Shotgun Shell Reloader" issued to Bachhuber et al on Aug. 10, 1976, for a more detailed description of a reloader incorporating an automatic primer feed.)

Figure 9A:
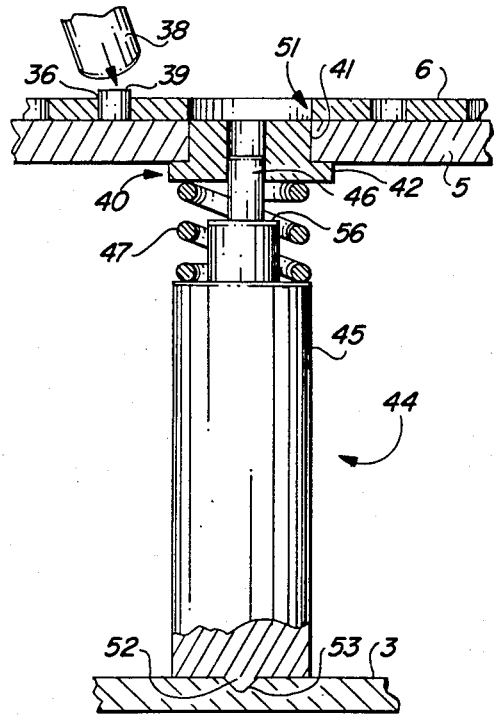
FIGS. 9*a*, 9*b* and 9*c* illustrate the sequence by which a new primer is emplaced in a primer receptacle and transferred to the spring pad axial aperture in which it is firmly held in the correct position by my unique spring pad assembly incorporating a magnet.

In accordance with the normal operation of reloaders of this class, when the handle 9 is actuated, the primer feed tube 38 is lowered to a position just above the single one 36 of the primer receptacles 18 positioned between the first and second stations, and a new primer 39 is dispensed from the primer tray 37 down the primer feed tube 38 and into the primer receptacle 36 as depicted in FIG. 9*a*. When the shell carrier 6 is subsequently indexed by a distance of one station, the primer is correspondingly moved across the second station and, before the shift is completed, drops into an axial spring pad aperture at the second station to permit the shell being brought to the second station to slide into position over the new primer before the repriming operation is completed.

Figure 7:
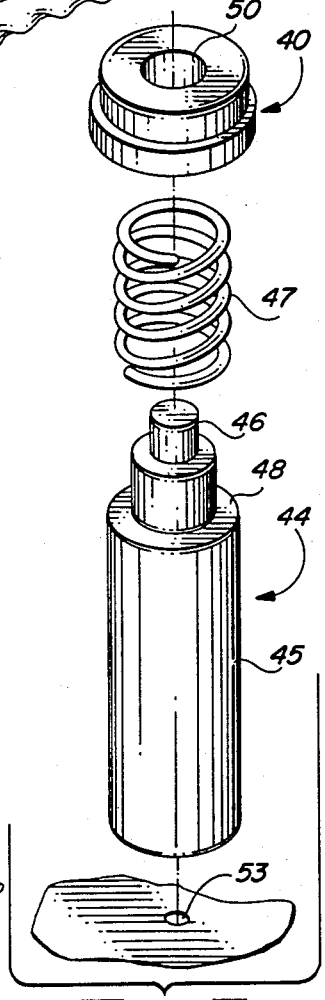
FIGS. 7 and 8 are exploded views from different angles of a spring pad assembly incorporating a feature of my invention directed to insuring correct emplacement of a new primer in anticipation of the repriming operation.
Figure 8:
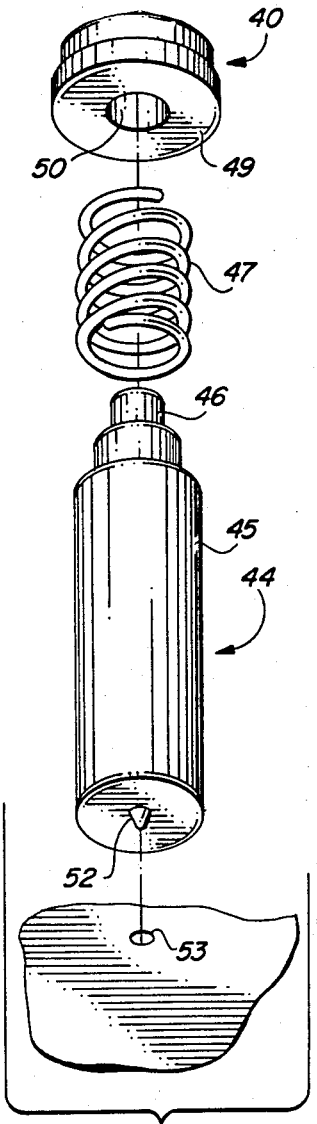
Figure 9B:
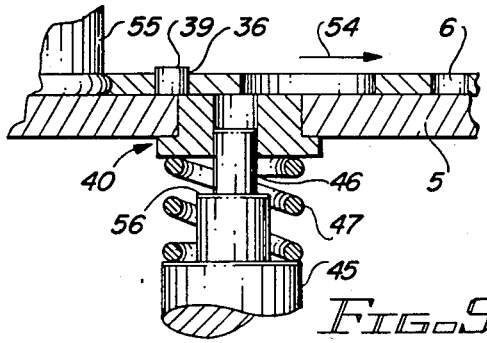
Figure 9C:
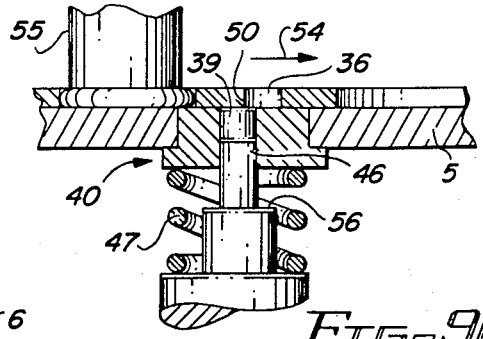

Attention is now directed to FIGS. 9*a*, 9*b* and 9*c* which illustrate this segment of the reloader operation in accordance with the present invention and to FIGS. 7 and 8 which illustrate detailed structure of the subject spring pad assembly. The spring pad assembly includes: (a) a spring pad 40 made of a non-magnetic material and having a first diameter 41 and a second, larger diameter 42 defining a shoulder 43 therebetween; (b) a guide post assembly 44 comprising a lower section 45 preferably made of a non-magnetic material and an upper section 46 which is a cylindrical magnet disposed with its axis vertical; and (c) a compression spring 47 which bears between a shoulder 48 of the guide post 44 and the lower surface 49 of the spring pad 40. The outside diameter of the cylindrical magnet 46 is such as to just fit into an axial aperture 50 through the spring pad 40, the axial aperture 50 also dimensioned as to just receive an axially aligned primer. As best shown in FIG. 9*a*, the spring pad assembly is situated at the second station between the base assembly 3 and the work table 5. The spring pad fits with its reduced diameter portion 41 situated within a slighty larger diameter aperture 51 through the work table 5 and is held in position by the upward force exerted by the compression spring 47.

Referring to FIGS 7, 8 and 9*a*, in order to accurately locate the bottom position of the guide post assembly 44, a small axial projection 52 extends into a correspondingly dimensioned and configured indentation 53 in the base assembly 3. Thus, it will be appreciated that the entire pad assembly can be installed and removed by lifting the guide post lower section 45 against the pressure of the spring 47 to disengage the projection 52 from the indentation 53 and sliding the guide post laterally. Further, it will be appreciated that the spring pad 40 is vertically downwardly movable against the spring 47 during the repriming operation.

As previousy noted, a new primer is deposited in the primer receptacle 36 positioned between the first and second stations prior to the movement of a deprimed shell between those two stations. FIG. 9*b* illustrates the position of a new primer 39 in the receptacle 36 as the movement of the shell carrier 6 has just commenced in the direction indicated by the arrow 54 such that the new primer 39 is moved toward the second station. In FIG. 9*c*, the receptacle 36 has swept across the upper surface of the spring pad 40, and the new primer 39 has been positively drawn downwardly by the magnetic force of the magnet 46 to rest on the magnet upper surface within the axial aperture 50 and beneath the upper surface of the spring pad 40 such that the oncoming deprimed shell 55 may slide into position at the second station axially aligned with and directly above the new primer 39. Subsequently, the reprime tube 58 (FIG. 1), in conventional fashion, is vertically lowered into the interior of the deprimed shell 55 to push it downwardly against the spring pad 40 which is depressed until its lower surface is stopped at a shoulder 56 atop the lower section 45 of the guide post assembly 44. Additional pressure downwardly on the interior of the base of shell 55 by the reprime tube pushes the new primer 39 home in its intended position in center of the base of the shell 55.. When the reprime tube is withdrawn, the newly reprimed shell is ready for translation to the next station for the next reloading operation, and the reloading sequence is continued to produce and the number of reloaded shells desired.

While the principles of the invention have now been made clear in illustrative embodiments, there will be immediately obvious to those skilled in the art many modifications of structure, arrangements, proportions, the elements, materials, and components, used in the practice of the invention which are particularly adapted for a specific environment and operating requirements without departing from those principles.

I claim:

1. A shotgun shell hand reloader assembly which includes:

(A) a plurality of stations at which successive reloading operations are performed on vertically upstanding, primer end down shells, said plurality of stations including a single entrance/exit station and an adjacent final station at which a last reloading operation is performed before a completed shell is moved to said entrance/exit station for removal;

(B) a horizontally disposed rotatable shell carrier fabricated of a non-magentic material, said shell carrier having a plurality of equally angularly spaced, peripherally disposed, radially directed recesses into which shells are entered and removed at said entrance/exit station, said shell carrier serving to move shells between successive stations and to accurately position and hold each shell at the proper station for performing a reloading operation;

(C) confining means peripherally encompassing said shell carrier at all stations except at said entrance/exit station such that removal of shells from any station except said entrance/exit station is inhibited;

(D) a vertical column which supports mechanism for performing depriming, repriming, powder charging, wad column charging, shot charging and crimping operations as a shell is advanced from station to station, at least one reloading operation being performed at each station, said vertical column being generally coaxial with the axis of rotation of said shell carrier;

(E) means supporting said shell carrier for rotation of said shell carrier about said vertical column; and (F) a generally horizontally disposed spring affixed to said column at a position immediately above said shell carrier, said spring having a straight portion horizontally extending, when unflexed, tangentially from said column and terminating at a free end proximate the outer edge of said shell carrier, said straight portion of said spring, when unflexed, being disposed proximate the edge of said entrance/exit station closest to said final station and extending generally parallel to a radius extending from the center of said column through the center of said entrance/exit station;

whereby, as a completed shell is translated by said shell carrier from said final station to said entrance/exit station, the completed shell engages and horizontally deflects said straight portion of said spring until the completed shell has been moved sufficiently into said entrance/exit station as to clear said confining means whereupon said spring ejects the completed shell from said entrance/exit station and returns to its unflexed state.

2. The shotgun shell hand reloader assembly of claim 1 which further includes a funnel having a generally upwardly opening large entrance end and a generally downwardly opening small discharge end, said small discharge end having a passage of sufficient diameter as to just permit the longitudinal passage therethrough of completed shotgun shells, said funnel positioned with respect to said shell carrier as to receive completed shells ejected from said entrance/exit station such that completed shells pass through said funnel and issue from said discharge end at a uniform angle.

3. A shotgun shell hand reloader assembly which includes:

(A) a plurality of stations at which successive reloading operations are performed on vertically upstanding, primer end down shells, said plurality of stations including:

1. a first station at which empty shells are introduced and completed shells are removed; and
2. a second station at which a repriming operation is performed, said second station being adjacent said first station;

(B) a horizontally disposed rotatable shell carrier fabricated of a non-magnetic material, said shell carrier having a plurality of equally angularly spaced, peripherally disposed, radially directed recesses into which shells are entered at said first station, said shell carrier serving to move shells between successive stations and to accurately position and hold each shell at the proper station for performing a reloading operation, said shell carrier further having a plurality of primer receptacles, each said primer receptacle being situated intermediate adjacent recesses;

(C) confining means peripherally encompassing said shell carrier at all stations except at said first station such that removal of shells from any station except said first station is inhibited;

(D) a work table supporting said shell carrier for rotation of said shell carrier about said vertical column;

(E) a spring pad-receiving aperture in said work table at said first station, the diameter of said spring pad-receiving aperture being slightly larger than the diameter of the primer end of a shell being reloaded;

(F) a vertically disposed spring pad assembly situated at said first station and disposed below said work table and vertically aligned with said spring pad-receiving aperture, said spring pad assembly comprising:

1. a spring pad made of non-magnetic material and having top and bottom surfaces and first, upper and second, lower outer diameters along the length thereof, said first outer diameter closely fitting said spring pad-receiving aperture, said second diameter being larger than said spring pad-receiving aperture whereby a shoulder is defined between said first and second diameters, said spring pad also having an axial aperture dimensioned to closely receive a primer;
2. a guide post assembly situated beneath said spring pad, said guide post assembly including:
   a. a lower section; and
   b. an upper section comprising a cylindrical magnet disposed with its axis vertical, the diameter of said magnet being such as to closely fit within said axial aperture of said spring pad; and
3. a compression spring bearing between said guide post assembly lower section and said bottom of said spring pad; and (G) means supporting said guide post assembly beneath said work table such that said spring pad is urged upwardly by said compression spring into said spring pad-receiving aperture with said shoulder normally seating against a bottom surface of said work table and said magnet extending into said axial aperture with its upper surface disposed beneath said upper surface of said spring pad;

whereby, during incrementation of said shell carrier by a distance of one station, a primer previously emplaced into the one of said primer receptacles previously situated intermediate said first station and said second station is carried to said second station at which it is magnetically pulled downwardly into said axial aperture of said spring pad to engage the upper surface of said magnet, thereby being held in the correct position for a repriming operation on a shell subsequently indexed to said second station.

4. The shotgun shell hand reloader assembly of claim 3 which further includes a primer dispenser adapted, upon actuation, to introduce a primer into the one of said primer receptacles then situated intermediate said first station and said second station.

* * * * *